US008968032B2

(12) United States Patent
Nomiyama et al.

(10) Patent No.: US 8,968,032 B2
(45) Date of Patent: Mar. 3, 2015

(54) STRUCTURE INCLUDING AN INTERFACE SECTION HAVING DISPLACEABLE CONTACT PORTIONS WITH REINFORCED PORTIONS

(75) Inventors: Toru Nomiyama, Tokyo (JP); Keisuke Nakamura, Tokyo (JP); Masafumi Kodera, Taichung (TW)

(73) Assignee: Japan Aviation Electronics Industry, Limited, Tokyo (JP)

( * ) Notice: Subject to any disclaimer, the term of this patent is extended or adjusted under 35 U.S.C. 154(b) by 128 days.

(21) Appl. No.: 13/814,286

(22) PCT Filed: Jul. 27, 2011

(86) PCT No.: PCT/JP2011/067044

§ 371 (c)(1),
(2), (4) Date: Apr. 11, 2013

(87) PCT Pub. No.: WO2012/017881

PCT Pub. Date: Feb. 9, 2012

(65) Prior Publication Data

US 2013/0210291 A1 Aug. 15, 2013

(30) Foreign Application Priority Data

Aug. 6, 2010 (JP) ..... 2010-177682

(51) Int. Cl.
*H01R 24/00* (2011.01)
*H01R 13/40* (2006.01)
(Continued)

(52) U.S. Cl.
CPC ..... *H01R 13/40* (2013.01); *H01R 13/6315* (2013.01); *H01R 24/62* (2013.01); *H01R 13/2442* (2013.01)
USPC ..... 439/660; 439/862

(58) Field of Classification Search
CPC ..... H01R 23/7073; H01R 23/02; H01R 13/2442; H01R 23/722
USPC ..... 439/862, 660, 630, 140
See application file for complete search history.

(56) References Cited

U.S. PATENT DOCUMENTS 6,038,130 A * 3/2000 Boeck et al. ..... 361/735
6,491,537 B1 12/2002 Watanabe
(Continued)

FOREIGN PATENT DOCUMENTS

CN 1304571 A 7/2001
JP 9-213396 8/1997
(Continued)

OTHER PUBLICATIONS

Taiwanese Office Action in Taiwanese application 100127172 dated Dec. 19, 2013, with English translation of relevant parts.
(Continued)

*Primary Examiner* — Phuong Dinh
(74) *Attorney, Agent, or Firm* — Collard & Roe, P.C.

(57) ABSTRACT

An interface section 200 of a structure 100 includes a plurality of contacts 120, each of the contacts having a contact portion 122 and a spring portion 126 which supports the contact portion 122 so that the contact portion 122 is displaceable in an up-down direction. The contact portions 122 of the contacts 120 are arranged in a pitch direction (X direction), and reinforcement portions 166 are positioned between the contact portions 122, respectively. The structure reinforces a side portion of the contact portion 122. Therefore, even if the contact portion 122 receives a force along the pitch direction (X direction), damage of the contact 120 can be prevented.

10 Claims, 7 Drawing Sheets

(51) Int. Cl.

| | |
|---|---|
| ***H01R 13/631*** | (2006.01) |
| *H01R 24/62* | (2011.01) |
| *H01R 13/24* | (2006.01) |

(56) References Cited

U.S. PATENT DOCUMENTS

| | | | | |
|---|---|---|---|---|
| 7,837,510 | B1 * | 11/2010 | Hung et al. | 439/660 |
| 2009/0017369 | A1 * | 1/2009 | Shih | 429/121 |

FOREIGN PATENT DOCUMENTS

| | | |
|---|---|---|
| JP | 2005-39944 | 2/2005 |
| TW | 200903914 A | 1/2009 |
| WO | WO 00/69031 | 11/2000 |

OTHER PUBLICATIONS

International Search Report of PCT/JP2011/067044, date of mailing Oct. 25, 2011.

Chinese Office Action in Chinese application 201180037214.0 dated Aug. 20, 2014, with English translation of relevant parts.

* cited by examiner

STRUCTURE INCLUDING AN INTERFACE SECTION HAVING DISPLACEABLE CONTACT PORTIONS WITH REINFORCED PORTIONS

CROSS REFERENCE TO RELATED APPLICATIONS

This application is the National Stage of PCT/JP2011/067044 filed on Jul. 27, 2011, which claims priority under 35 U.S.C. §119 of Japanese Application No. 2010-177682 filed on Aug. 6, 2010, the disclosure of which is incorporated by reference. The international application under PCT article 21(2) was not published in English.

TECHNICAL FIELD

This invention relates to a structure which comprises an interface section having displaceable contact portions and, in particular, relates to a mechanism protecting the contact portions.

BACKGROUND ART

For example, Patent Document 1 discloses a connector which comprises a mechanism protecting contact portions of contacts. The connector includes a holder member and protection covers, wherein the holder member holds the contact portions so that the contact portions project upwards, and the protection covers protect the contact portions, respectively.

PRIOR ART DOCUMENTS

Patent Document(s)

Patent Document 1: JP 2005-39944 A

DISCLOSURE OF INVENTION

Problems to be Solved by Invention

However, there is a possibility in the connector of Patent Document 1 that certain directions or strengths of external forces might damage the protection covers as well as the contacts.

It is therefore an object to provide a structure comprising an interface section which is tolerant to an imaginable force on the basis of a suitable combination of the arrangement of contact portions of contacts and reinforcement thereof.

Means for Solving the Problems

The present invention provides a structure which comprises a plurality of contacts, a holder member, a reinforcement member and urging means. Each of the plurality of contacts has a contact portion and a spring portion which supports the contact portion so that the contact portion is displaceable along an up-down direction. Each of the contact portions has two reinforced portions. The holder member holds the plurality of contacts. Because of the holding, the plurality of contacts are arranged in a pitch direction perpendicular to the up-down direction, and side surfaces of the reinforced portions of neighboring one of the contact portions face each other in the pitch direction. The reinforcement member has a reinforcement portion. When the reinforcement member is positioned at an initial position, the reinforcement portion is positioned between the neighboring contact portions so as to reinforce, at least in part, the reinforced portions facing each other. The urging means urges the reinforcement member to move towards the initial position.

Advantageous Effect of Invention

Under a disconnection state of the structure and a mating structure, the reinforcement portion reinforces side portions of the contact portions which project from the holder member. Thus, the contacts are protected suitably.

The neighboring contact portions can share a single reinforcement portion because each reinforcement portion is provided between the neighboring contact portions in the pitch direction. Therefore, the structure can be downsized.

BEST MODE FOR CARRYING OUT INVENTION

Figure 1:
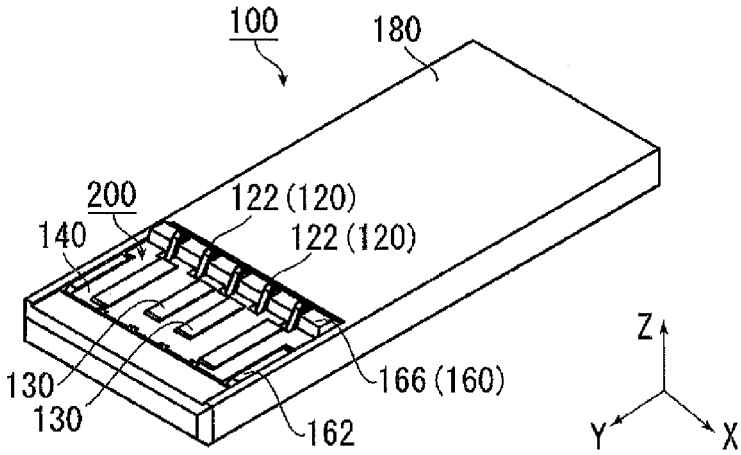
FIG. 1 is a perspective view showing a structure according to an embodiment of the present invention.
Figure 2:
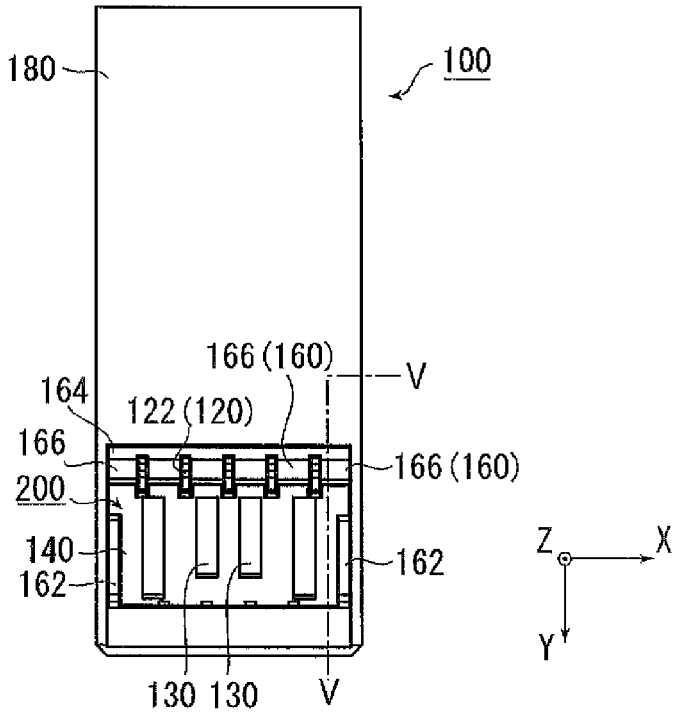
FIG. 2 is a top plan view showing the structure of FIG. 1.
Figure 3:
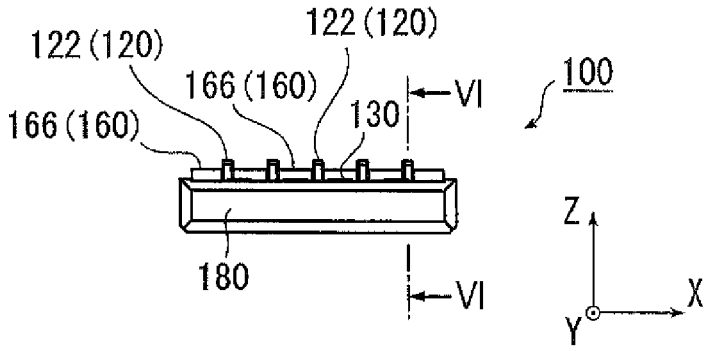
FIG. 3 is a front view showing the structure of FIG. 1.

With reference to FIG. 1 to FIG. 6, the structure 100 according to the embodiment comprises a plurality of contacts 120 made of metal, a plurality of additional contact portion 130 made of metal, a holder member 140 made of insulative material, a reinforcement member 160 made of insulative material and a case 180 made of insulative material.

Figure 10:
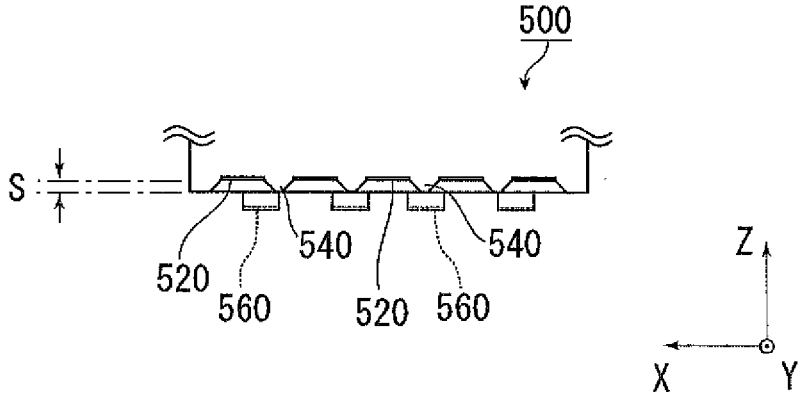
FIG. 10 is a front view showing a mating structure which is connectable with the structure of FIG. 1.

A connection object of the structure 100 is a mating structure 500. As partially shown in FIG. 10, the mating structure 500 has a plurality of mating contact portions 520, a plurality of protrusion ribs 540 and additional mating contact portions 560. The mating contact portions 520 are portions to be connected with the contacts 120. The mating contact portions 520 and the protrusion ribs 540 are alternately aligned in a pitch direction (an X direction: a width direction). As understood from FIG. 10, the protrusion rib 540 projects from the mating contact portion 520 by a predetermined size S in an up-down direction (a Z direction). The additional mating contact portions 560 are provided so as to be displaceable. The additional mating contact portions 560 are portions to be connected with the additional contact portion 130. The additional mating contact portions 560 are arranged differ from the mating contact portions 520 in a front-back direction (a Y direction) so as not to prevent a connection between the mating contact portions 520 and the contacts 120. The additional mating contact portions 560 are illustrated with dotted lines because a relation between the mating contact portions 520 and the protrusion ribs 540 are brought into focus in FIG. 10.

Figure 7:
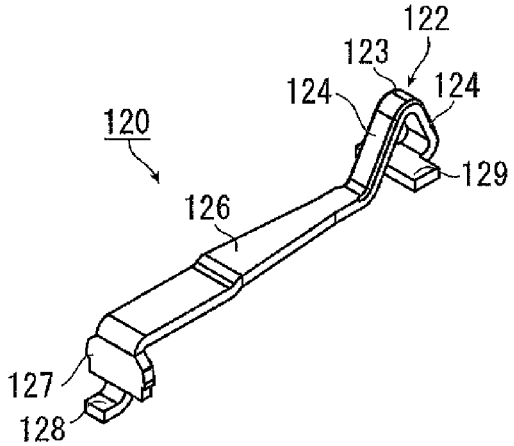
FIG. 7 is a perspective view showing a contact included in the structure of FIG. 1.

As shown in FIG. 7, each of the contacts 120 of the structure 100 has a contact portion 122, a spring portion 126, a held portion 127, a fixed portion 128 and a supporter portion 129. The contact portion 122 is brought into contact with the mating contact portion 520. The spring portion 126 supports the contact portion 122. The held portion 127 extends downward from one end of the spring portion 126. The fixed portion 128 is provided to a lower end of the held portion 127. The supporter portion 129 is provided to the front end of the contact portion 122.

The contact portion 122 is bent in an inverted V-like shape. In other words, the contact portion 122 has a A-like (a peak-like) shape, and a top portion 123 of the contact portion 122 projects upwards. Both side portions of the contact portion 122 constitute reinforced portions 124 reinforced by the reinforcement member 160 (described hereafter). In other words, each of the contact portions 122 has two reinforced portions 124.

The supporter portion 129 is made to be widened than a width of the contact portion 122. In other words, the supporter portion 129 has a shape jutting sideways in comparison with the contact portion 122. Therefore, the contact portion 122 and the supporter portion 129 constitute a T-like shape.

The spring portion 126 uses its resilience and supports the contact portion 122 displaceable in the up-down direction. The held portion 127 is made to be widened in comparison with the spring portion 126 or the like, and press-fit projections press-fitted into holder member 140 are provided on sides of the held portion 127. The fixed portion 128 is a portion configured to be fixed to the circuit board 320 (see FIG. 9) by soldering or the like.

Figure 8:
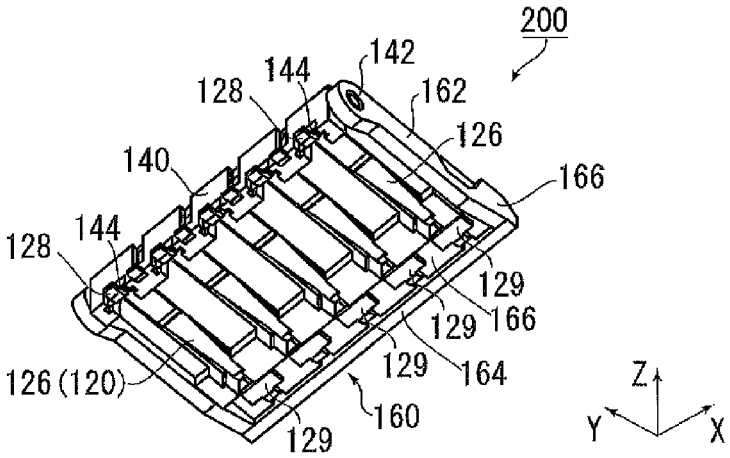
FIG. 8 is a perspective view showing an interface section included in the structure of FIG. 1, as seen from below.
Figure 9:
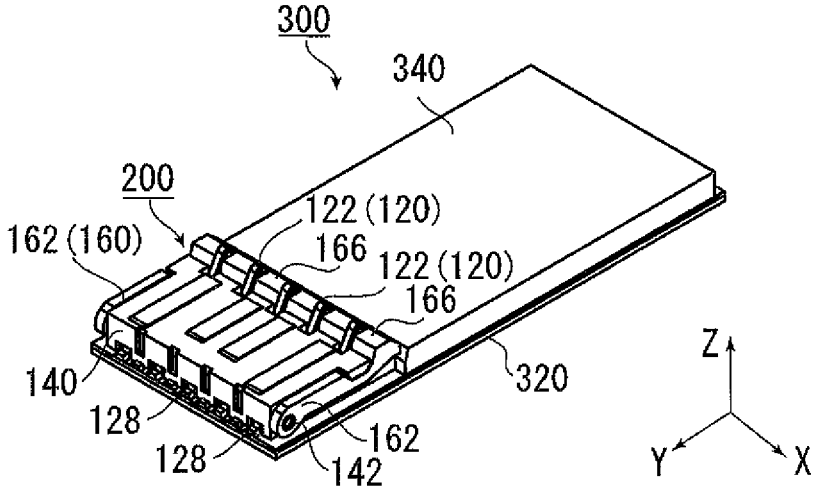
FIG. 9 is a perspective view showing an assembly included in the structure of FIG. 1.

As shown in FIG. 1, FIG. 2, FIG. 5, FIG. 8 and FIG. 9, the holder member 140 arranges and holds a plurality of the contacts 120 in line in the pitch direction (the X direction). In detail, the held portions 127 are press-fitted in holding grooves 144 provided in the vicinity of a front end of the holder member 140 so that the contacts 120 are held by the holder member 140. By being held in this way, a plurality of the contact portions 122 are lined in the pitch direction (an X direction), side surfaces 124' (see FIG. 4) of the reinforced portions 124 of one of the neighboring contact portions 122 in the pitch direction (the X direction) are faced each other in the pitch direction (the X direction). Moreover, the supporter portion 129 has a larger size than the width of the contact portion 122 in the pitch direction (the X direction) because a broad-width direction of the supporter portion 129 is oriented in the pitch direction (the X direction). As shown in FIG. 8 and FIG. 9, the holder member 140 is provided with pivot portions 142 projecting outward in the pitch direction (the X direction).

Figure 5:
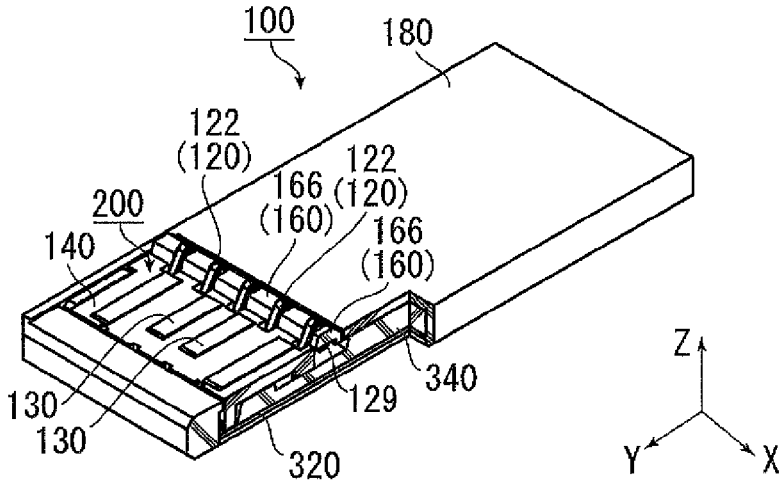
FIG. 5 is a perspective view showing the structure of FIG. 2, partially cut out along line V--V.
Figure 6:
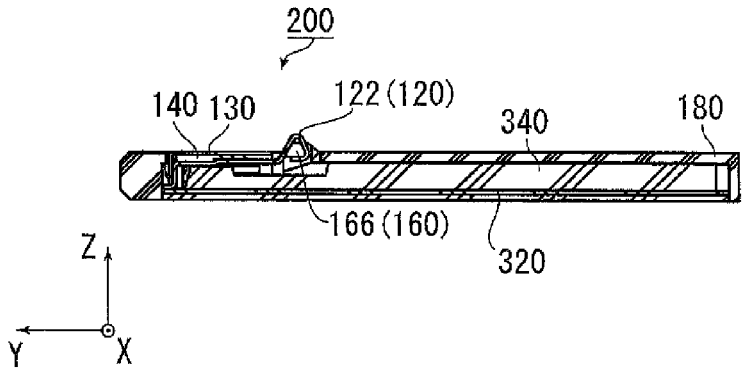
FIG. 6 is a cross-sectional view showing the structure of FIG. 3, taken along line VI-VI.

As shown in FIG. 5, FIG. 8 and FIG. 9, the reinforcement member 160 has two arm portions 162 and a coupling portion 164 coupling the arm portions 162 in the pitch direction (the X direction). Approximately, the reinforcement member 160 has a rectangular C-shape. The arm portions 162 are pivotally supported by pivot portions 142 provided on the holder member 140.

The coupling portion 164 is formed with slits corresponding the contact portions 122 of the contacts 120. As a result, the reinforcement portions 166 are formed between the slits, respectively, of the coupling portion 164. An interface section 200 shown in FIG. 8 is assembled by attaching the reinforcement member 160 to the holder member 140, followed by inserting the contacts 120 in the holder member 140. Upon this insertion, the contact portions 122 are inserted between the slits, respectively, from below. According to the insertion, the reinforcement portion 166 is positioned between the neighboring contact portions 122, in the pitch direction (the Y direction), faced each other.

When an assembly 300 shown in FIG. 9 is assembled, the interface section 200 is mounted and fixed on the circuit board 320 on which a package 340 made by molding an IC chip or the like with resin is mounted. The interface section 200 is mounted and fixed on the circuit board 320 so that a rotation range of the reinforcement member 160 is limited to a predetermined extent defined the holder member 140 and the circuit board 320. In two limitation positions defining a rotatable range, one of the limitation positions, where a projection amount of the reinforcement portion 166 from the holder member 140 is at the maximum, is defined as an initial position. In other words, the reinforcement portion 166 projects from the holder member 140 to the most extent when the reinforcement member 160 is at the initial position.

As shown in FIG. 5 and FIG. 8, a bottom surface of the reinforcement portion 166 (i.e. a bottom surface of the coupling portion 164) is supported by supporter portions 129 of the contacts 120. Therefore, the reinforcement member 160 is urged to move towards the initial position. In other words, the contacts 120 also serve as an urging means for urging the reinforcement member 160 to move towards the initial position.

The structure 100 shown in FIG. 1 is obtained by accommodating the assembly 300 (see FIG. 9) in a case 180 with the interface section 200 exposed. As understood from FIG. 1, an arrangement of the contact portions 122 and the additional contact portions 130 is similar to that of an interface section of a plug connector of standard-A USB 3.0. However, a metal shell is not provided in comparison with the USB connector so that the whole structure 100 is downsized.

Figure 4:
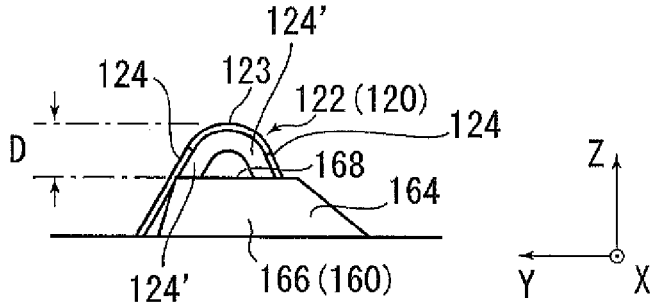
FIG. 4 is an enlarged, side view showing contact portions and around them of the structure of FIG. 1.

Moreover, in the structure 100 of the embodiment, the reinforcement portion 166 exists between the reinforced portions 124 of neighboring one of the contact portions 122 in the pitch direction (the X direction). As a result, the reinforcement portion 166 reinforces, at least in part, the reinforced portions 124 as seen in the pitch direction (the X direction), as shown in FIG. 4. Therefore, even if a force directed in the pitch direction (the X direction) is exerted to the contact portions 122, the reinforcement portions 166 can receive the reinforced portions 124 of the contact portions 122. As a result, the contacts 120 can be prevented from being damaged as much as possible.

In order to obtain an effect which prevents damage of the contacts 120, it is preferable that a size of the reinforcement portion 166 in the pitch direction is more than two third of a distance between the neighboring contact portions 122. In order to reduce a clearance between the contact portion 122 and the reinforcement portion 166 as match as possible and to reinforce with reliability, it is more preferable that a size of the reinforcement portion 166 in the pitch direction (the X direction) is more than 80% of a distance between neighboring contact portions 122 in the pitch direction.

In this embodiment, the supporter portions 129 support the reinforce portion 166 of the reinforce portion 160 so that a displacement of the contact portion 122 of the contact 120 is connected with another displacement of the reinforcement portion 166. Therefore, according to this embodiment, a weakening of protection of the contact portions 122 of the contacts 120 because of an undesired displacement of the reinforcement portion 166 alone does not occur.

On the other hand, in the structure 100, a position relation between the contact portion 122 and the reinforcement portion 166 is defined, in consideration of another position relation between the mating contact portion 520 and the protrusion ribs 540, so that the protrusion ribs 540 push the reinforcement portion 166 down before a contact between the contact portions 122 and the mating contact portions 520. To be more specific, as shown in FIG. 4, the top portion 123 of the contact portion 122 of the contact 120 projects upward from the uppermost portion 168 of the reinforcement portion 166 when the reinforcement member 160 is positioned at the initial position. Under this state, a distance D between the top portion 123 and the uppermost portion 168 of the reinforcement portion 166 in the up-down direction (the Z direction) is larger than a projection size (the predetermined size S) of the protrusion rib 540 of the mating structure 500. Therefore, the protrusion ribs 540 do not push down the reinforcement portions 166 and contact portions 122 before the contact portions 122 are brought into contact with the mating contact portions 520.

(A First Modification)

In the above-described structure 100 (see FIG. 1 and FIG. 4), the distance D between the top portion 123 and the uppermost portion 168 of the reinforcement portion 166 is defined in consideration of the projection size (the predetermined size S) of the protrusion rib 540 of the mating structure 500. However, the present invention is not limited thereto.

Figure 11:
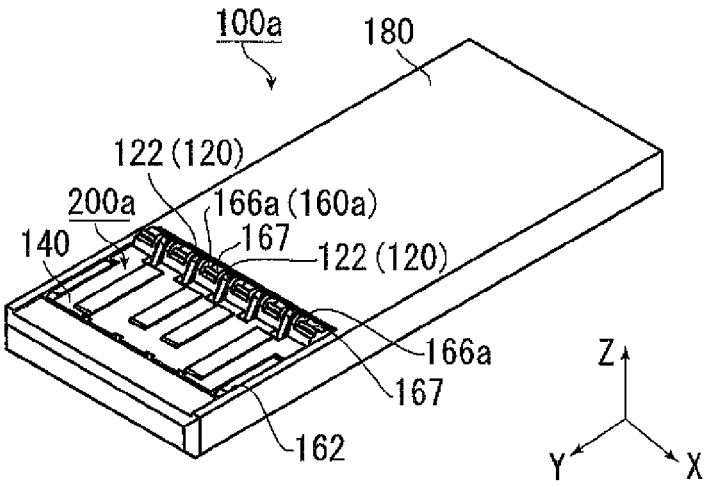
FIG. 11 is a perspective view showing a structure according to a first modification.

With reference to FIG. 11, a structure 100*a* of the first modification has an interface section 200*a* similar to the interface section 200 according to the above-described embodiment except for a shape of the reinforcement portion 166. In detail, the reinforcement portion 166*a* is provided with depression portion 167 depressed downward by a size in consideration of the projection size (the predetermined size S). Therefore, an exposed size of the reinforced portion 124 can be reduced so that a protection of the contact portion 122 is ensured. A contact between protrusion rib 540 and the reinforcement portion 166*a*, which may prevent another contact between the contact portion 122 and the mating contact portion 520, can be avoided.

For example, when the mating structure 500 has no protrusion ribs 540, the reinforcement portion 166 may be formed so that almost the entire contact portion 122 is covered with the reinforcement portion 166 as seen in the pitch direction (the X direction) without providing the depression portion and that the contact portion 122 is completely protected. In this case, the mating contact portion 520 has a thickness in the Z direction so that the contact portion 122 is firstly connected with the mating contact portion 520.

(A Second Modification)

The above-described structure (see FIG. 1, FIG. 8 and FIG. 9) comprises the reinforcement member 160 independent of other members. However, the present invention is not limited thereto. For example, with reference to FIG. 12 to FIG. 14, the arm portion 182 and the reinforcement portion 186 are constituted as a part of a case 180*b* in a structure 100*b* according to the second modification.

Figure 12:
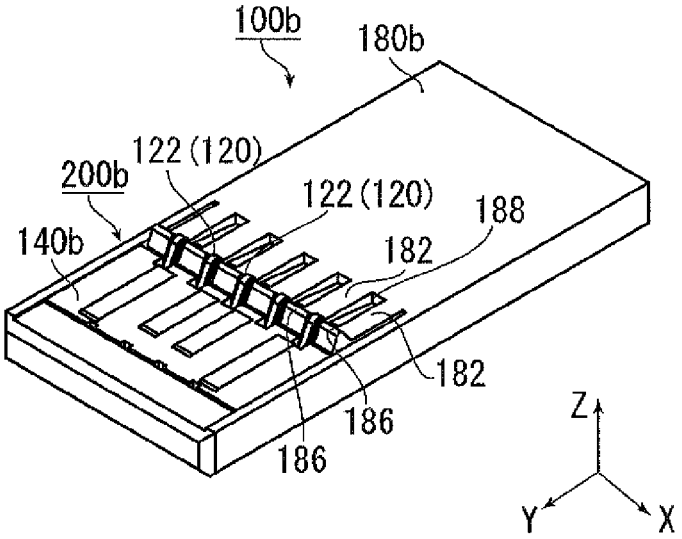
FIG. 12 is a perspective view showing a structure according to a second modification.
Figure 13:
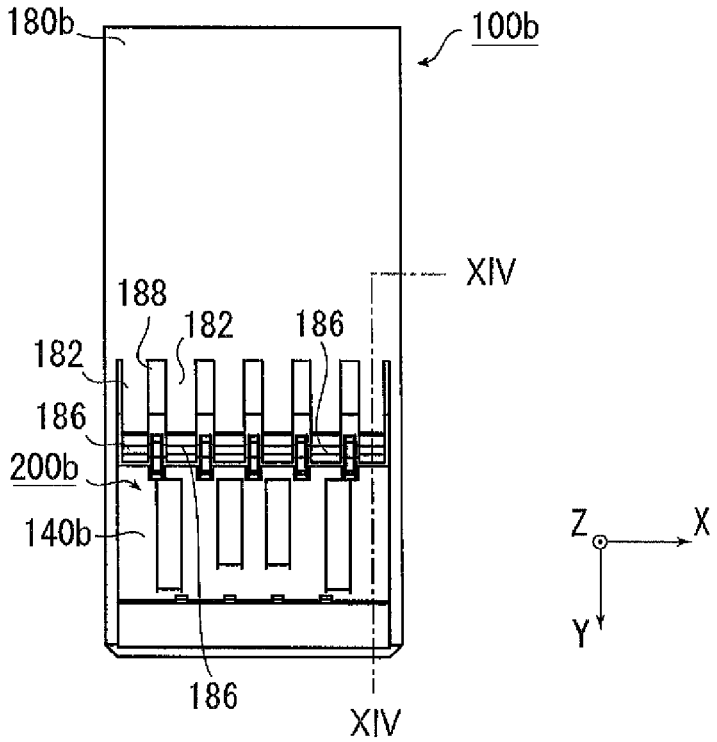
FIG. 13 is a top plan view showing the structure of FIG. 12.
Figure 14:
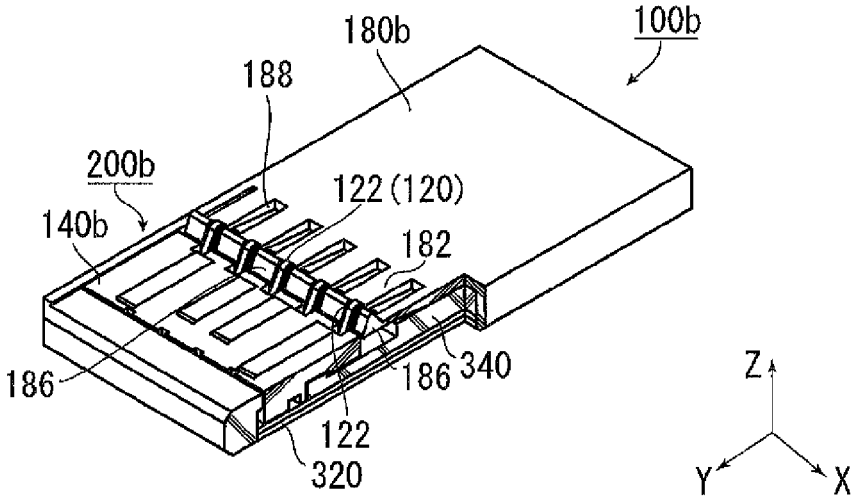
FIG. 14 is a perspective view showing the structure of FIG. 13, partially cut out along XIV--XIV line.

As shown in FIG. 12 to FIG. 14, the arm portion 182 according to the second embodiment is provided for every reinforcement portion 186 so that the reinforcement portions 186 are not connected with each other in the pitch direction. The arm portions 182 are provided to the case 180 so that a holder member 140*b* has no need to pivotally support the arm portions 182. Therefore, the holder member 140*b* is not provided with the pivot portion. The contact 120 according to the embodiment has a structure same as the contact 120 according to the above-described embodiment. The bottom of the reinforcement portion 186 is supported by the supporter portions 129 of end portions of the contacts 120 (a supporting condition is not shown).

In the structure 100*b* according to the second embodiment, grooves 188 are provided to the case 180*b* in order to form the arm portions 182 so that a contamination or the like may enter inside the case 180*b* through grooves 188. Therefore, the structure 100 according to the above-described embodiment is preferable to the structure 100*b* according to the second embodiment in view of a protection of the package 340 accommodated in the cases 180, 180*b*.

(A Third Modification)

The contacts 120 also serve the urging means for urging the reinforcement member 160 to move towards the initial position in the structure 100 (see FIG. 1, FIG. 5 and FIG. 8) according to above-described embodiments. However, the present invention is not limited thereto.

Figure 15:
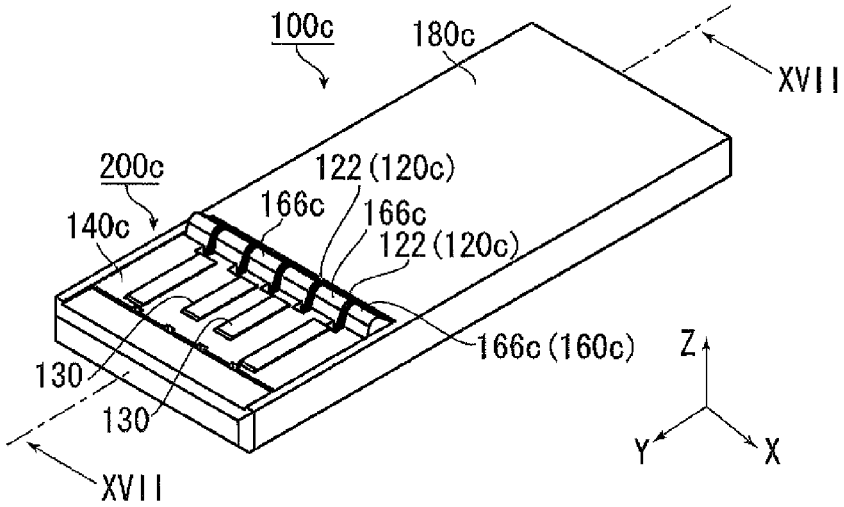
FIG. 15 is a perspective view showing a structure according to a third modification.
Figure 16:
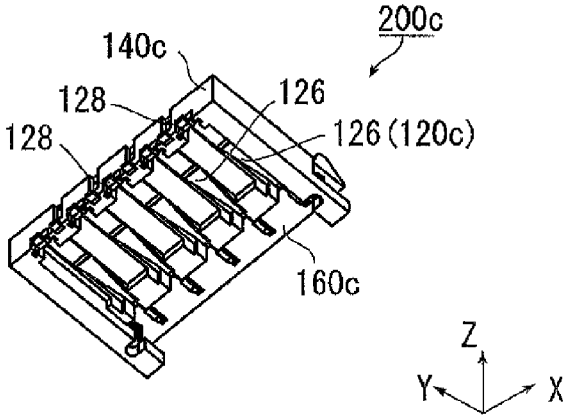
FIG. 16 is a perspective view showing an interface section included in the structure of FIG. 15, as seen from below.
Figure 17:
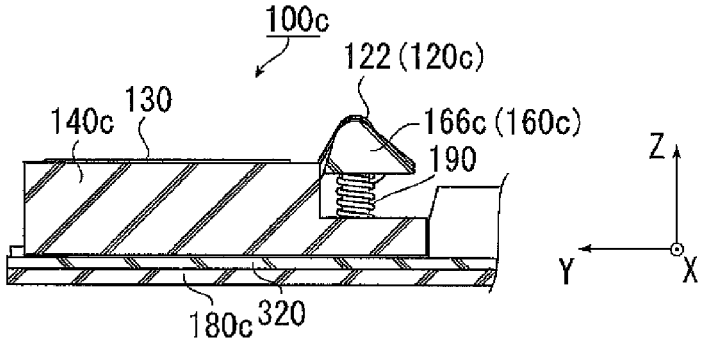
FIG. 17 is a cross-sectional view showing a part of the structure of FIG. 3, taken along line XVII-XVII.

With reference to FIG. 15 to FIG. 17, an interface section 200*c* of a structure 100*c* according to the third modification comprises a plurality of contacts 120*c*, additional contact portions 130, a holder member 140*c* holding the contacts 120*c*, a reinforcement member 160*c* and resilient member (a spring) 190. As understood from FIG. 15, the structure including the interface section 200*c* is accommodated in the case 180*c* with the interface section 200*c* exposed.

As understood from FIG. 15 and FIG. 16, the reinforcement member 160*c* is constituted by coupling a plurality of reinforcement portion 166*c* in the pitch direction (the X direction). The resilient member 190 pushes its bottom surface up so that the reinforcement member 160*c* is urged to move towards the initial position.

On the other hand, the contacts 120*c* have a structure having no supporter portion 129 (see FIG. 7) so that the reinforcement portion 166*c* can be displaced independently of a displacement of the contact portion 122 of the contact 120*c*.

If a displacement of the reinforcement portion 166*c* is not connected with another displacement of the contact portion 122 of the contacts 120*c*, the contact between the protrusion ribs 540 and the reinforcement portion 166*c* does not prevent the contact between the contact portion 122 and the mating contact portion 520, for example even though the mating structure 500 has the protrusion ribs 540. However, there is possibility that the appropriate protection of the contacts 120 is not attained when only reinforcement portion 166*c* is displaced by undesired external force or the like so that a degree of exposure of the reinforced portion 124 is increasing to excess. Therefore, the displacement of the contact portion 122 of the contact 120 and the displacement of the reinforcement portion 166 are preferable to be connected, as the structure 100 according to the above-described embodiments.

With citing specific examples, the explanation was made about the present invention as above. However the present invention is not limited thereto. For example, the holder member and the case are different-pieces in any of above-described embodiment and the modifications. However, the holder member and the case may be a single-piece.

INDUSTRIAL APPLICABILITY

The present invention can be applied to a memory card or a connector which has the interface section described above.

DESCRIPTION OF NUMERALS

100, 100*a*, 100*b*, 100*c* structure
120 contact (urging means)
120*c* contact
122 contact portion
123 top portion
124 reinforced portion
124' side surface
126 spring portion
128 fixed portion
129 supporter portion
130 additional contact portion
140, 140*b*, 140*c* holder member
142 pivot portion
144 holding groove
160, 160*a*, 160*c* reinforcement member
162 arm portion
164 coupling portion
166, 166*a*, 166*c* reinforcement portion
167 depression portion
168 uppermost portion
180, 180*b*, 180*c* case
182 arm portion
186 reinforcement portion
188 groove
190 resilient member (urging means)
200, 200*a*, 200*b*, 200*c* interface section
300 assembly
320 circuit board
340 package
500 mating structure
520 mating contact portion
540 protrusion rib
560 additional mating contact portion

The invention claimed is:

1. A structure comprising:

a plurality of contacts each having a contact portion and a spring portion supporting the contact portion so that the contact portion is displaceable along an up-down direction, each of the contact portions having two reinforced portions;

a holder member holding the plurality of contacts so that the plurality of contacts are arranged in a pitch direction perpendicular to the up-down direction and that side surfaces of the reinforced portions of neighboring ones of the contact portions face each other in the pitch direction;

a reinforcement member having a reinforcement portion, the reinforcement portion is positioned between the neighboring contact portions when the reinforcement member is positioned at an initial position, so as to reinforce, at least in part, the reinforced portions facing each other; and urging means for urging the reinforcement member to move towards the initial position.

2. The structure according to claim 1, wherein:

the reinforcement member has a plurality of the reinforcement portions; and two of the plurality of the reinforcement portions are positioned, in the pitch direction, outside of outermost ones in the pitch direction of the contact portions.

3. The structure according to claim 1, wherein:

the reinforcement member has a coupling portion and arm portions, the coupling portion supporting the reinforcement portions and coupling the arm portions; and the arm portion is supported by the holder member to be rotatable so that the reinforcement portion is displaceable in the up-down direction.

4. The structure according to claim 1, further comprising a case accommodating the holder member, wherein:

each of the arm portions is formed as a part of the case and extends in a front-back direction perpendicular to both the up-down direction and the pitch direction; and the reinforcement portion is supported by the arm portion so as to be displaceable in the up-down direction.

5. The structure according to claim 1, wherein the spring portion urges the contact portion to project from the holder member.

6. The structure according to claim 1, wherein a size of the reinforcement portion in the pitch direction is more than two third of a distance between the neighboring contact portions.

7. The structure according to claim 1, wherein:

the contact is further formed with a supporter portion which extends from the contact portion and supports the reinforcement portion;

the contact uses the support of the reinforcement portion by the supporter portion and resilience of the spring portion to also serve as the urging means; and a displacement of the reinforcement are connected with another displacement of the contact portion.

8. The structure according to claim 7, wherein the supporter portion has a size larger than that of the contact portion in the pitch direction.

9. The structure according to claim 1, wherein:

the urging means is formed of a resilient member distinct from the contact; and a displacement of the reinforcement portion is independent of another displacement of the contact portion.

10. The structure according to claim 1, wherein:

the structure is connectable with a, mating structure which has a plurality of mating contact portions and a plurality of protrusion ribs;

the mating contact portions and the protrusion ribs are arranged alternately in the pitch direction;

the protrusion rib projects from the mating contact portion by a predetermined size in the up-down direction; and a distance between a top of the contact portion and an uppermost portion of the reinforcement portion in the up-down direction is larger than the predetermined size.

* * * * *